United States Patent [19]

Benning

[11] Patent Number: 4,836,406

[45] Date of Patent: Jun. 6, 1989

[54] CLOSURE FOR A PRESSURIZED FLUID-FILLED CONTAINER

[75] Inventor: Friedrich Benning, Schwetzingen, Fed. Rep. of Germany

[73] Assignee: Deere & Company, Moline, Ill.

[21] Appl. No.: 98,102

[22] Filed: Sep. 17, 1987

[30] Foreign Application Priority Data

Sep. 17, 1986 [DE] Fed. Rep. of Germany ..... 3631528

[51] Int. Cl.[4] ..... B65D 15/16

[52] U.S. Cl. ..... 220/203; 220/DIG. 32

[58] Field of Search ..... 220/203, 208, 209, 303, 220/DIG. 32

[56] References Cited

U.S. PATENT DOCUMENTS 3,136,292 6/1964 Mitchell ..... 220/DIG. 32
4,185,751 1/1980 Moore et al. ..... 220/203
4,196,822 4/1980 Avrea ..... 220/203
4,498,599 2/1985 Avrea ..... 220/203

*Primary Examiner*—George T. Hall

[57] ABSTRACT

A closure for a pressurized container, such as a coolant radiator, provides overflow protection by means of a tube connecting the highest point of the container with the filler neck. The end of the tube in the filler neck is closed by a cap having a high pressure relief valve. The closure cap also contains a low pressure relief valve connected to the tube which, together with the high pressure relief valve, maintains a pressure balance in the container without substantial change in the amount of fluid therein. Both valves are connected directly to a bleed line to atmosphere or a reservoir. The tube and filler neck together serve to regulate the pressure in the container and to provide a maximum fluid level within the container.

9 Claims, 1 Drawing Sheet

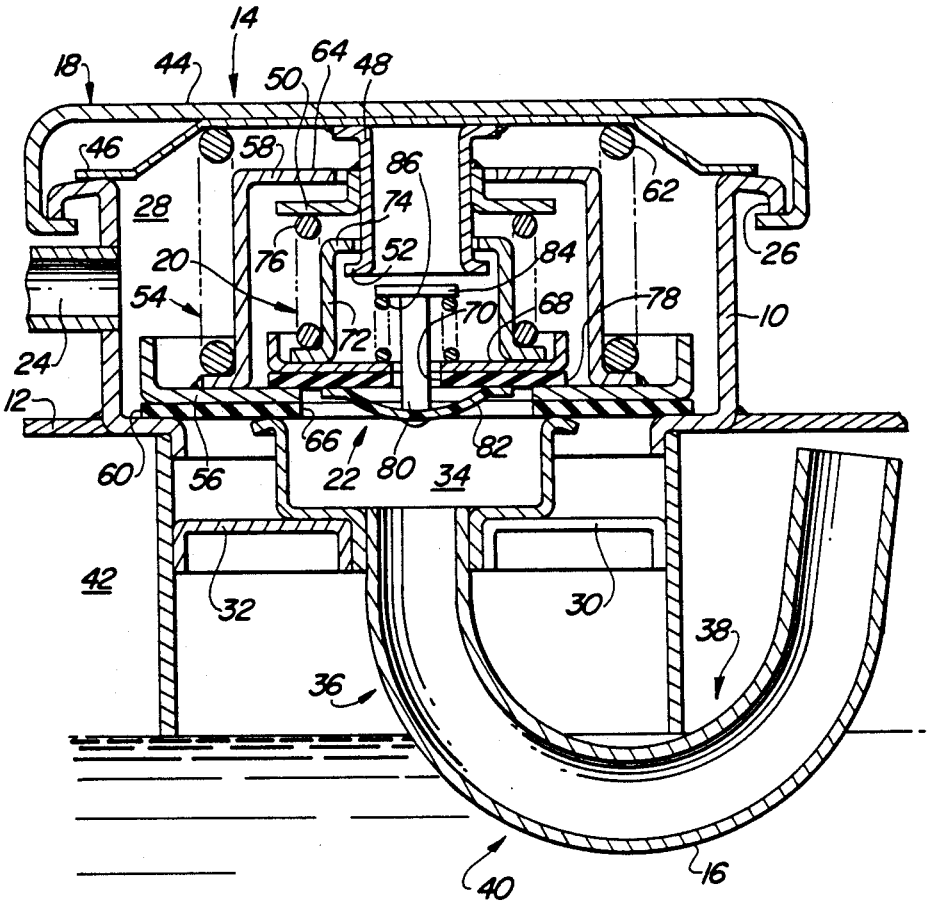
14
18
44
50
64
48
46
58
86
62
28
74
26
20
76
52
84
54
70
68
78
10
24
72
12
66
82
60
56
22
80
34
42
32
30
38
36
40
16

CLOSURE FOR A PRESSURIZED FLUID-FILLED CONTAINER

BACKGROUND OF THE INVENTION

1. Field of the Invention

The present invention relates to a closure for the filler neck of a container normally filled with fluid, where the fluid is subject to varying pressures and temperatures, e.g., a cooling or hydraulic system.

2. Description of the Related Art

In one known closure, DE-AS No. 1 254 908, the lower portion of a U-shaped tube is provided with a throttling restriction. This lower portion is immersed in fluid in the container to determine the fluid level. Any pressure that may have build up in the space above the fluid, either as a gaseous mixture or as air, can be released through the tube when the closure cap is removed, thereby avoiding ejection of hot fluid directly from the container. A bleed line is provided, but the tube is separated therefrom by two seals when the closure cap is installed. A pressure relief valve also is provided, at the top of the container, but does not have any connection with the bleed line.

This closure has the disadvantage that the throttling restriction permits fluid to enter the tube at all times, and to the height of the fluid in the container. This fluid then is ejected when the closure cap is removed and may injure the operator. In addition, opening of the pressure relief valve may eject fluid, which will cause fluid loss and possibly damage. These disadvantages give rise to the further disadvantage that the fluid level constantly is changing, which may be detrimental to the operation of the fluid system connected to the container.

In another known closure, DE-PS No. 3 007 272, a filler neck is arranged at an angle in the side wall of a coolant radiator to control the fill level of the coolant in the radiator. The space above the collant is filled with air and is connected by a tube to a sealing surface on the filler neck which is sealed by the closure cap. The tube is opened upon removal of the closure cap, establishing a connection between the air space and atmosphere. A pressure relief valve is provided in the closure cap, where it constantly is exposed to the coolant. When the pressure relief valve is opened, it provides a connection by way of a bleed line between the atmosphere and the interior of the radiator.

With this closure, it may be possible to avoid expulsion of hot coolant upon opening of the cap, since the pressure of the coolant is reduced by an initial, partial opening of the closure cap. However, increased coolant level due to heat expansion leads to a flow of the additional volume of coolant through the bleed line. In addition, it is possible to overfill the container with coolant. The coolant then is unable to flow off through the bleed line with the closure cap is installed, as generally occurs immediately after filling.

Although this closure cap represents an improvement over the first case cited above, it does not provide a satisfactory solution as the described disadvantages show.

SUMMARY OF THE INVENTION

The aforementioned problems are solved according to the present invention by using a tube opened only at its end in conjunction with a filler neck extending into the container. The tube extends between the topmost part of the container and the pressure-relief valve, which opens directly to the bleed line.

During filling of the container, the tube is at least partially filled with fluid. When the fluid in the container reaches slightly above the bottom of the extended filler neck, no more fluid can be added—the only possible exit for the remaining air in the container is through the tube, and it has fluid in it.

The entrapped air in the container nevertheless can be relieved through the tube. When the pressure rises during operation, the minimal amount of fluid in the tube will be expelled through the pressure-relief valve and bleed line, so that the air thereafter can easily move through the tube, Thus, the fluid in the tube is expelled into the closed system, not upon release of the closure cap.

BRIEF DESCRIPTION OF THE DRAWING

The single drawing illustrates a cross-sectional view of a preferred embodiment of the present invention.

DETAILED DESCRIPTION OF THE PREFERRED EMBODIMENT

A filler neck 10 of a container 12, here a coolant radiator, is provided with a closure 14 according to the present invention. The closure 14 consists generally of a U-shaped tube 16 and a closure cap 18 having a high pressure relief valve 20 and a low pressure relief valve 22. A bleed line 24 also is provided.

The filler neck 10 is provided with a rim 26 for a bayonet lock, though it can equally well be fitted with an external thread. The filler neck 10 is connected to the highest point of the container 12, at which point only air is able to accumulate. The upper region of the filler neck 10 has a chamber 28 which is connected radially by the bleed line 24 with the atmosphere or a reservoir (not shown). In the lower region of the chamber 28, the filler neck 10 is soldered to the container 12 with a reduced inside diameter. A radial wall 32 is provided in the reduced inside diameter portion of the neck, and includes filler openings 30. The wall 32 extends to the surface of the tube 16, with which it is connected directly or indirectly. The reduced diameter portion of the filler neck 10 extends into the container 12 to the selected fluid level.

The tube 16 is shown here in a U-shaped configuration, but it could equally well have a V-shape or an entirely different shape. The important feature of the design of the U-shaped tube 16 is that only the ends are open, that is, that the lower region 40 is closed entirely between the two upper ends formed by the two legs 36, 38. In this example, the first leg 36 ends in a funnel 34 and the second leg 38 ends near the upper edge of the container 12.

The cap 18 includes a cover 44 having a leaf spring 46 above the high pressure relief valve 20. When the closure cap 18 is installed, the leaf spring 46 acts against the rim 26 to retain the closure cap 18. A sleeve 48 with a collar 50 and an upset end 52 extends from the inner side of the cover 44 along its center line, with the upset end 52 having an outside diameter smaller than the collar 50. An axially movable bleed valve 54 is concentric with the sleeve 48, and is fitted with a disk 56 and a retaining cap 58 connected to each other. A seal 60 is attached with adhesive to the lower side of the disk 56, that is, on the side facing the funnel 34, and makes contact with both the rim of the funnel 34 and the floor of the chamber 28. The seal 60 is compressed by the spring 62, which acts between the upper side of the disk 56 and the lower side of the cover 44. The side of the retaining cap 58 facing away from the disk 56 has an inner collar 64 with a central hole, whose diameter is smaller than the outside diameter of the collar 50. The inner collar 64 is located axially between the collar 50 and the underside of the cover 44, and is forced by the spring 62 along with the disk 56 in a direction away from the cover 44. When the closure cap 18 is removed, the inner collar 64 makes contact with the collr 50. Finally, the central area of the disk 56 contains a hole 66 whose diameter generally corresponds to the inside diameter of the funnel 34.

The high pressure relief valve 20 is identical in design, although not in size, to the bleed valve 54. It also includes a disk 68 containing a hole 70 and a retaining cap 72 with an inner collar 74 which contains a hole. In addition, a spring 76 extends between the upper side of the disk 68 and the lower side of the collar 50 and a seal 78 is provided on the lower side of the disk 68. The inner collar 74 can move axially between the lower side of the collar 50 and the upper side of the upset end 52, and is biased away from the collar 50 to make contact with the upper side of the upset end 52. The outside diameter of the disk 68 and the seal 78 attached to its lower side are so defined that it makes contact with the rim of the disk 56 of the bleed valve 54 about the hole 66 and is forced into that contact by the spring 76. When the closure cap 18 is installed, neither of the inner collars 64, 74 are in contact with the collar 50 or the upset end 52, and the springs 62, 76 have not reached their minimum lengths. In addition, there are intervening gaps between the inner collars 64, 74 and the sleeve 48, as well as between the collar 50 and the upset end 52.

The low pressure relief valve 22 consists of a shaft 80, a sealing component 82, a plate 84 of larger diameter than the shaft 80 and a spring 86. The sealing component 82 consists of a compliant but stiff plastic, for example, hard rubber, and has an outside diameter that nearly corresponds to the diameter of the hole 66. The shaft 80 is axially movable, extends through the hole 70 in the disk 68 of the pressure relief valve 20, is rigidly attached to the sealing component 82 at its lower end and at its upper end to the plate 84. The spring 86 is inserted between the underside of the plate 84 and the upper side of the disk 68 of the pressure relief valve 20 and forces the shaft 80 upwards so that the upper side of the sealing component 82 is forced against the underside of the seal 78 of the disk 68. The springs 62, 76 are so designed that the opening of the bleed valve 54 requires a higher pressure than the opening of the high pressure relief valve 20. In addition, the distance between the inner collar 64 and the collar 50 is greater than the distance between the inner collar 74 and the upset and 52, when the closure cap is installed.

OPERATION

To fill the container 12, the closure cap 18 is removed and fluid is poured through the filler neck 10 into the container 12. It flows primarily through the filler openings 30 in the wall 32 until the fluid level reaches the lower edge of the filler neck 10, specifically the area of its reduced diameter. Some fluid may pass through the funnel 34 and tube 16 once the filler neck 10 lower edge is reached, and possibly before. However, once the tube 16 is filled and the fluid reaches the lower edge of the filler neck, no air can escape from the space 42 in the container. Thus, the container 12 cannot be filled past the proper fluid level.

The closure cap 18 is installed on the filler neck 10 and retained by the bayonet lock. The seals 60 and 78 make contact with the sealing surfaces described above, and close the container 12 completely. The sealing component 82 is, and remains, in sealing contact with the seal 78.

When the fluid in the container 12 heats up during use, the fluid level increases, as does the pressure of the air or gas in the space 42. This pressure is transmitted through the tube 16 to the disk 68 of the high pressure relief valve 20 and lifts this from the upper side of the disk 56 of the bleed valve 54 when a predetermined pressure is exceeded. The minor amount of fluid that enters the tube 16 during filling is forced out, and thereafter, only trapped air escapes. Thus, the amount of fluid in the container 12 does not change substantially.

When the fluid in the container 12 cools off, a vacuum will develop in the container 12. When this exceeds a pre-determined value, the sealing component 82 separates from the underside of the seal 78 and air from the atmosphere or from the reservoir flows into the container 12 so that the pressure therein is equalized. Thus, there is no net change in the amount of fluid in the container 12.

If the closure cap 18 is removed at a time when the fluid level is elevated and the pressure in the container is high, perhaps for maintenance purposes, after an inital turn of the bayonet lock to the first detent (or with a screw cap after the first two or three turns), the inner collar 64 will be retained against the upper surface of the funnel 34 by the spring 62, while at the same time the seal 78 is lifted from disk 56. Thus, while the closure cap 18 is still partially locked to the filler neck 10, air under pressure flows from the space 42 through the gap between the seal 78 and the disk 56, and the gap between the inner collar 64 and the collar 50, to reduce the pressure of the fluid. In other words, the high pressure relief valve 20 is opened while the bleed valve 54 still holds the container closed. During the subsequent removal of the closure cap 18 frm the filler neck 10, no fluid will be expelled and the closure cap 18 can be removed without any danger. The operator does not even come in contact with the hot air being expelled, since this escapes through the bleed line 24.

Although the present invention has been described with reference to a particular embodiment thereof, various modifications thereto will be readily apparent to one of ordinary skill in the art. Accordingly, the invention is intended to be limited only by the following claims.

We claim:

1. A closure for a container generally filled with fluid, where the fluid is subject to varying pressures and temperatures, the closure comprising:

a filler neck extending into the container and having a sealable end outside the container;

a closure cap for closing said filler neck sealable end;

a tube extending between a first end in an uppermost part of said container and a second end in an interior of said filler neck, said tube being open at both ends and closed therebetween;

a bleed line connected to said filler neck; and a pressure relief valve interposable between said bleed line and said second tube end.

2. The clousre of claim 1, wherein the height of the fluid in said container is determined by the extent to which said filler neck extends into said container.

3. The closure of claim 1, wherein said pressure relief valve is disposed in said closure cap.

4. The closure of claim 1, further comprising a low pressure relief valve interposable between said bleed line and said second tube end.

5. The closure of claim 4, wherein said low pressure relief valve is disposed in said closure cap.

6. The closure of claim 4, wherein said high pressure relief valve and said low pressure relief valve close said second tube end when said container is closed.

7. A closure for a container generally filled with fluid, where the fluid is subject to varying pressures and temperatures, the closure comprising:

a filler neck extending into the container and having a sealable end outside the container;

a tube having a first open end in an uppermost part of said container and a second open end inside said filler neck, said tube being closed between said ends;

a bleed line connected to said filler neck;

a closure cap for selectively sealing said sealable filler neck end;

a high pressure relief valve disposed in said cap and interposed between said second tube end and said bleed line when said cap is sealing said filler neck; and a low pressure relief valve disposed inside said pressure relief valve.

8. The closure of claim 7, further comprising a bleed valve disposed inside said closure cap, said high and low pressure relief valves being disposed inside said bleed valve.

9. A closure for a container generally filled with fluid, where the fluid is subject to varying pressures and temperatures, the closure comprising:

a filler neck extending into the container to about the desired fluid level and having a sealable end outside the container;

a U-shaped tube having a first open in an uppermost part of said container and a second open end inside said filler neck, said tube being closed between said ends;

a bleed line connected to said filler neck;

a closure cap for selectively sealing said sealable filler neck end, said cap having:

a bleed seal for sealably engaging said sealable filler neck end, said bleed seal having a central opening therein;

a high pressure relief seal for sealably engaging the edge of said bleed seal central opening, said high pressure relief seal having a central opening therein; and a low pressure relief seal for sealably engaging the edge of said high pressure relief seal central opening, each of said seals being biased towards a sealing position and cooperating to seal said filler neck when said closure cap is attached thereto.

* * * * *